US005595601A

United States Patent [19]

Lintula

[11] Patent Number: 5,595,601

[45] Date of Patent: Jan. 21, 1997

[54] COATING BAR FOR A BAR COATER

[75] Inventor: Timo Lintula, Keuruu, Finland

[73] Assignee: Valmet Corporation, Helsinki, Finland

[21] Appl. No.: 399,753

[22] Filed: Mar. 7, 1995

Related U.S. Application Data

[63] Continuation-in-part of Ser. No. 85,964, Jun. 30, 1993, abandoned, which is a continuation-in-part of Ser. No. 697,075, May 8, 1991, Pat. No. 5,264,247.

[30] Foreign Application Priority Data

Sep. 14, 1990 [FI] Finland ..... 904541

[51] Int. Cl.[6] ..... B05C 1/08; B05C 11/02

[52] U.S. Cl. ..... 118/110; 118/118; 118/119; 118/258; 118/414; 492/35; 492/58

[58] Field of Search ..... 118/110, 118, 118/119, 262, 410, 414, 419, 256, 258; 15/256.5, 256.52; 100/174; 101/162; 162/281; 427/191, 252, 383.7, 436, 250, 255.4, 399, 359; 29/527.2; 492/35, 58

[56] References Cited

U.S. PATENT DOCUMENTS

| | | | |
|---|---|---|---|
| 2,729,192 | 1/1956 | Warner | 118/262 |
| 3,084,663 | 4/1963 | Warner | 118/119 |
| 4,226,922 | 10/1980 | Sammells | 429/104 |
| 4,348,980 | 9/1982 | Thevenot et al. | 148/279 |
| 4,435,482 | 3/1984 | Futamura et al. | 428/553 |
| 4,469,532 | 9/1984 | Nicolas | 148/6.35 |
| 4,637,837 | 1/1987 | Von Matuschka et al. | 148/6 |
| 4,869,933 | 9/1989 | Sollinger et al. | 118/414 |
| 5,283,121 | 1/1994 | Bordner | 492/58 |

*Primary Examiner*—Donald E. Czaja
*Assistant Examiner*—Steven P. Griffin
*Attorney, Agent, or Firm*—Steinberg, Raskin & Davidson, P.C.

[57] ABSTRACT

A coating bar for a bar coater, wherein the coating bar is supported substantially over its entire length revolving in a cradle fixed to the frame of the coater. The coating bar is profiled and surface-treated by boronizing so that a layer of iron boride is applied to the profiled surface of the coating bar.

20 Claims, 6 Drawing Sheets

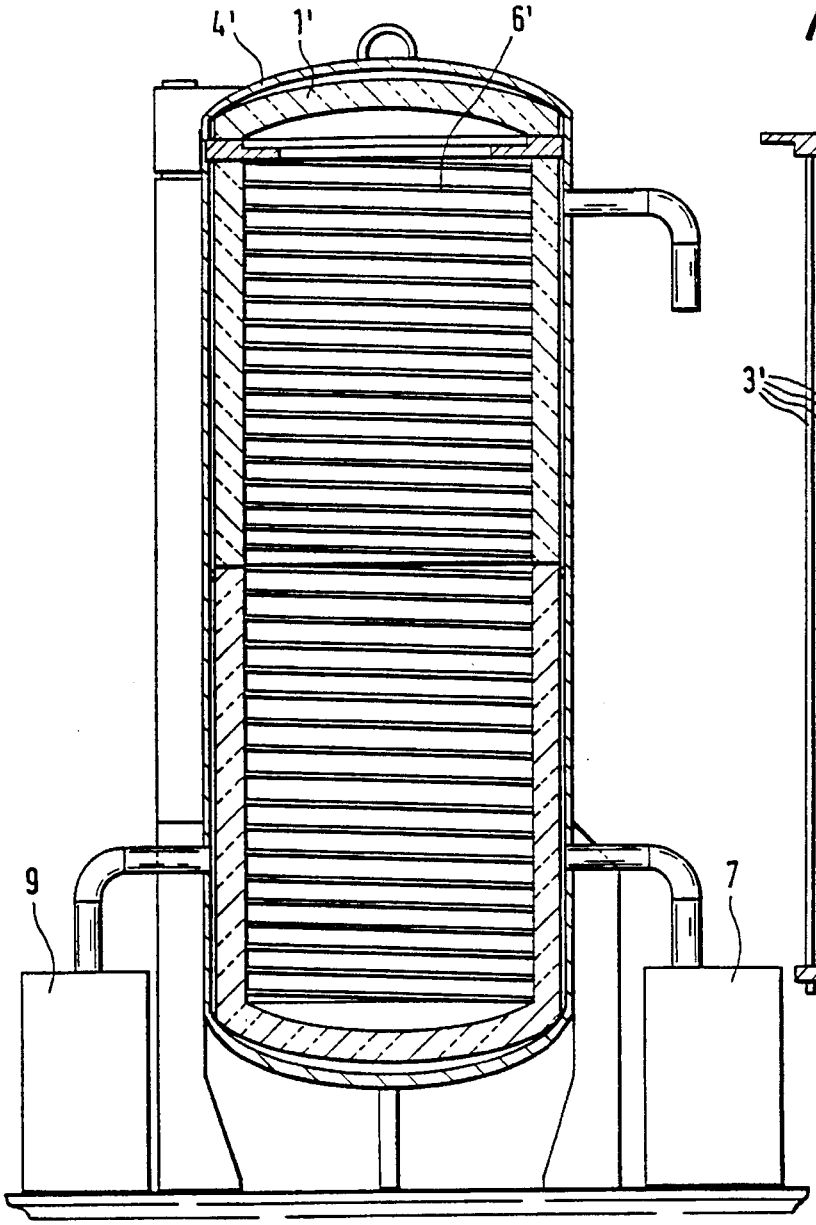
FIG. 3
FIG. 3a
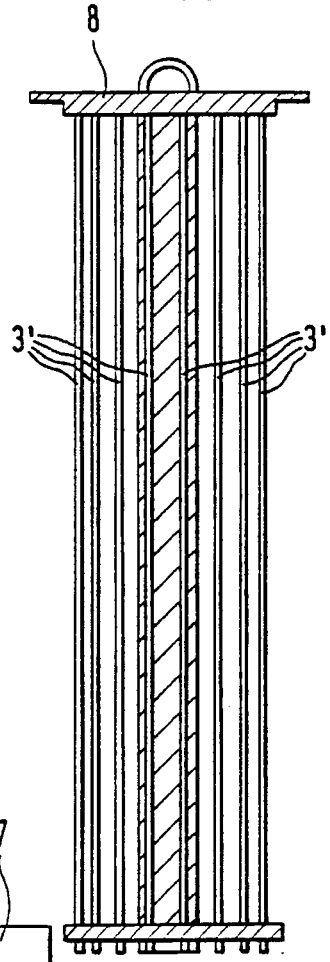

| | | |
|---|---|---|
| L | 500 - 12 000 | mm |
| A | 0 - 500 | mm |
| d | 8 - 50 | mm |

RANGES OF VARIATION OF PARAMETERS:

| | | |
|---|---|---|
| r1 | 0,05 - 0,250 | mm |
| r2 | 0,05 - 0,250 | mm |
| H1 | 0,05 - 0,250 | mm |
| H2 | 0,05 - 0,250 | mm |
| φ1 , φ2 | 70 - 150 | ° |
| D | 0,100 - 0,500 | mm |
| PITCH 0,200...1,000 , THREAD WITH 1...7 STARTS | | |

COATING BAR FOR A BAR COATER

This application is a continuation-in-part of application U.S. Ser. No. 08/085,964, filed Jun. 30, 1993, now abandoned, which in turn is a continuation-in-part of application U.S. Ser. No. 07/697,075, filed May 8, 1991, now U.S. Pat. No. 5,264,247.

FIELD OF THE INVENTION

The present invention relates to a coating bar for a bar coater, wherein the coating bar is supported substantially over its entire length as revolving in a cradle fixed to the frame of the coater. The coating bar includes a substantially cylindrical metallic core having a profiled outer core surface defining a plurality of grooves extending circumferentially around the core. The core has a core surface layer bounded by the profiled outer core surface and containing FeB and $Fe_2B$. The coating bar also includes a discrete metallic coating containing both FeB and $Fe_2B$ situated in direct contact with the profiled outer core surface and an exposed outer bar surface.

BACKGROUND OF THE INVENTION

A bar coater is employed in coating of paper, particularly in cases where the possibility exists that the coating blade in a blade coater will produce streaks in the paper surface. In order to avoid this problem, attempts have been made to prevent such streaks using a coating bar. Typically, the coating bar is rotated in the direction opposite to the running direction of the web, at a rate of from about 10 to about 600 revolutions per minute. Coating bars are provided with suitable drive gears to rotate the bar, and in coating machines wider than usual, the bars are usually provided with drives at each end of the bar to avoid torsional vibrations.

When a bar coater is used, the coating process itself can be performed, e.g., so that the coating agent is scraped off the web surface by means of the coating bar. A bar coater may also be constructed as a so-called short-dwell unit, wherein the coating agent is introduced into a coating-agent chamber. A coating agent chamber is defined by a front wall, the coating bar, and by the base to be coated itself, which base may be the face of a counter roll, the paper web, or equivalent.

The coating bar is mounted such that it is able to revolve in a cradle made of a suitable material, such as polyurethane. Normally, the bar is supported in the cradle over its entire length. A groove for water is usually provided in the cradle, in connection with the bar. The water circulates in the groove in order to lubricate, to cleanse and to cool the coating bar.

Traditionally, as a coating bar, a hard-chromium plated wire bar has been used. For example, the bar doctor in the SYM-SIZER size press (trademark of Valmet Paper Machinery, Inc.), a size press used for surface sizing and coating of paper operated by the principle of short-dwell coating, has traditionally been a bar around which a stainless-steel wire is wound. Hereupon the bar has been hard-chromium plated to improve its resistance to wear. The wound wire forms regular slots in the bar surface, by means of which slots the quantity of size to be applied to the roll face can be regulated. The size of the slots and, consequently, the quantity of size can be regulated by using different wire diameters.

Drawbacks of such a wire bar include short service life, tendency of the wire to be broken and thereby to enter into the nip, with resulting damage to the roll coating and a standstill. Further problems include poor wear resistance of the bar, as well as unsuitability of the bar for thermal and thermo-chemical coating processes, because the wire may be broken during the process. Further difficulties arise in the quality of the coating process, because the coating does not become uniform with long bars and does not adhere properly.

A bar doctor composed of ceramic bushings is also known in the art, by whose means attempts have been made to solve the above problem of wear resistance. The success of such attempts has been unsatisfactory in practice. Grooved bars having a hard-chromium plating on their surface have also been employed.

OBJECTS AND SUMMARY OF THE INVENTION

An object of the present invention is to provide a coating bar which does not have the drawbacks of the bars mentioned above and which has a higher resistance to wear.

It is another object of the present invention to provide a coating bar having a coating layer of iron boride comprising both FeB and $Fe_2B$ which is directly applied on a profiled surface of a base material of the coating bar.

These objects and others are achieved by the present invention, which relates to a coating bar which is profiled and surface-treated by boronizing. The coating bar includes a substantially cylindrical metallic core having a profiled outer surface defining a plurality of grooves extending circumferentially around the core. The core has a core surface layer bounded by the profiled outer surface and comprising ferrous boride, e.g., FeB and $Fe_2B$ which is achieved by a boronizing surface-treatment process. Further, by continuing the boronizing surface-treating process, a discrete metallic coating containing both FeB and $Fe_2B$ is formed on the profiled outer surface of the core. The metallic coating is in direct contact with the profiled outer core surface and has an exposed outer bar surface. For purposes of the present invention, the compounds FeB and $Fe_2B$ are referred to as iron borides. Other ferrous borides, or iron borides, may also be produced by means of the present invention wherein iron in the metallic core interacts with boron.

The boronizing can be carried out either by means of a powder package process in the horizontal or vertical position, or by means of a paste process in a separate vacuum oven. Boronizing by the powder package process utilizes boron carbide. The boron is diffused into the surface layer of the coating bar. This is accomplished, for example, by submerging the coating bar in an oven heated preferably to a temperature of about 800° C. to about 1050° C.

The preferred boronizing process for the coating bar in accordance with the invention is the surface treatment process based on diffusion by whose means the composition of the surface layer on the steel of the metallic core is modified. In the surface layer, a layer of iron boride containing both FeB and $Fe_2B$ is formed by means of the treatment operating at a high temperature, e.g. from about 800° C. to about 1050° C. The outer profiled surface of the metallic core thus contains both FeB and $Fe_2B$ which has been diffused therein. In addition, as a result of the continuation of the diffusion process, at least one discrete coating layer of both FeB and $Fe_2B$ is formed on the profiled surface wherein a first side of the coating layer is in direct contact with the profiled surface and a second, opposed side of the coating layer is exposed to contact the coating agent.

Because the surface-treatment process is based on diffusion, the grooves applied to the bar before the boronizing treatment do not cause problems. Consequently, a uniform hard and wear-resistant surface layer of a thickness of from about 5 microns to about 250 microns is obtained. In a preferred embodiment, the thickness of the coating layer is from about 15 microns to about 25 microns.

The concentration of boron in the layer of ferrous boride is preferably from about 2% to about 20%, preferably at least 8% by weight of the total weight of the layer of iron boride. For example, in a particularly preferred embodiment, the surface layer of the coating bar includes a concentration of boron of about 16.23 percent by weight in the FeB compound and a concentration of boron of about 8.83 percent by weight in the $Fe_2B$ compound.

The present invention in which the coating bar has a profiled outer surface containing iron borides provides advantages which cannot be achieved by means of prior art wire bars because a wire bar cannot be boronized since the wire would break during the boronizing treatment. On the other hand, a grooved bar can be chromium-plated, but its resistance to wear is inferior to that of a boronized bar. The hardness of a conventional hard-chromium plated bar is of an order of from about 700 to about 1100 HV units, whereas by means of a boronized bar in accordance with the invention, hardness levels of about 1100 to about 1700 HV are readily attained. Preferably, a hardness of the coating bar of about 1400 to about 1700 HV is attained. The specific hardness of the coating bar is partially a result of the formation of a coating layer of ferrous boride (FeB and $Fe_2B$) directly on the outer profiled surface of the coating bar.

Another advantage of the coating bar in accordance with the invention is that the boronized bar has a greater hardness than a bar with a hard-chromium plated face and therefore its service life is longer. The reason for discarding a coating bar is either breaking of the wire or the fact that the size quantity no longer meets the requirements, as the profile becomes lower and the size volume is reduced. Typical service lives of bars with conventional hard-chromium coatings vary from a few hours to 3 or 4 weeks. The rate of wear is usually approximately inversely proportional to hardness. With the greater hardness of the boronized bar, a longer service life is obtained.

In general, a bar coater in which the coating bar in accordance with the invention is utilized operates so that a regular volume remains between the bar and the roll. The volume has been provided either in accordance with the prior art e.g., by winding a wire around a 10 mm base bar, or in the manner suggested in the present invention, by forming a regular groove pattern onto a, e.g., 10 mm bar, of which there may be a number of different types.

By virtue of the combination of the invention, incorporating the surface treatment process (boronizing) with a grooved bar substituted for the prior art wire bar, a service life is attained which is longer than with the prior art coating bars.

BRIEF DESCRIPTION OF THE DRAWINGS

In the following, the invention will be described by way of example with reference to the figures in the accompanying drawings.

FIGS. 3 and 3*a* show an embodiment of boronizing in accordance with the invention wherein the boronizing is carried out by means of the paste process.

DETAILED DESCRIPTION OF THE INVENTION

Figure 1:
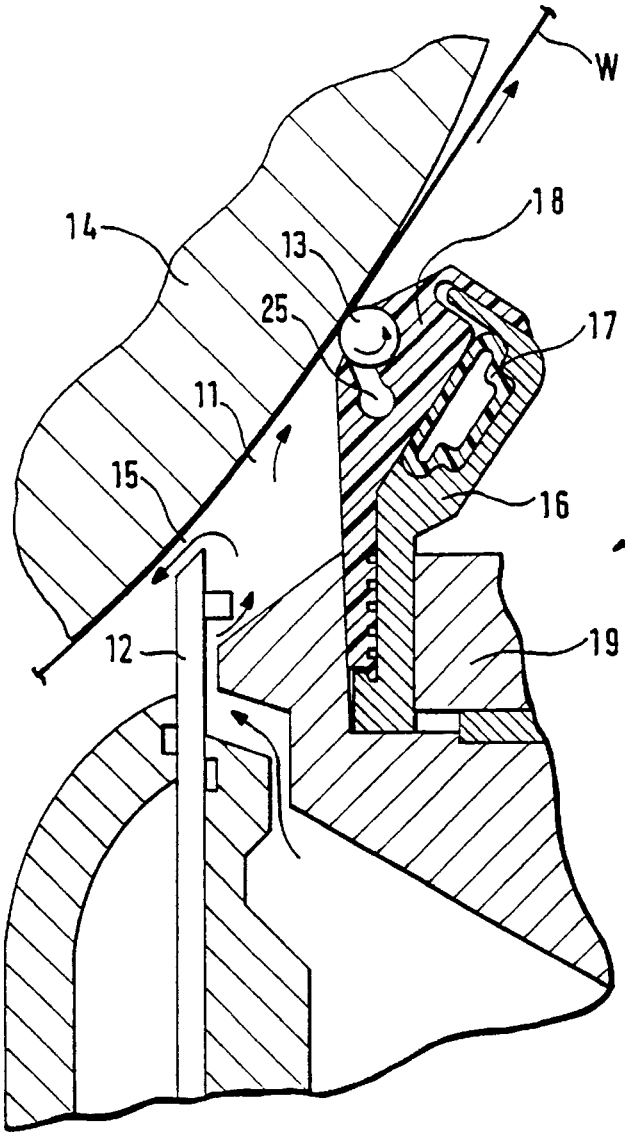
FIG. 1 is a schematic sectional side view of a bar coater in which a coating bar in accordance with the invention is employed.

Referring to the accompanying drawings wherein like reference numerals refer to the same elements, FIG. 1 shows an exemplifying embodiment of a bar coater in which the bar in accordance with the invention can be applied. In FIG. 1, the coater is denoted generally with reference numeral 10. The coater 10 is a bar coater, in which a coating bar 13 is, in the embodiment shown in FIG. 1, fitted against a paper or board web W that runs on a face of a backup roll 14.

The coater 10 shown in FIG. 1 is a coater of the so-called short-dwell type, wherein the coating agent is introduced into a coating-agent chamber 11 placed before the coating bar 13 in the running direction of the web W. The coating-agent chamber 11 is defined by the coating bar 13, by the web W, by the front wall 12 of the coating-agent chamber 11, and by lateral seals (not shown). The coating-agent chamber 11 is pressurized in any manner known in the art, and out of the chamber 11 an overflow of the coating agent is arranged through the gap 15 between the front wall of the coating-agent chamber and the web W.

The coating bar 13 is fitted in a cradle 18 made of a suitable material, e.g., polyurethane. The cradle supports the coating bar 13 substantially over its entire length. The coating bar 13 is provided with a dedicated drive gear, by whose means the coating bar 13 is rotated in the direction opposite to the direction of running of the web W. The cradle 18 of the coating bar 13 is fitted in a support 16, and both the cradle 18 and the support 16 are together fixed in a holder 19 mounted on the frame of the coater 10. Moreover, on the support 16, underneath the cradle 18, a loading hose 17 is provided, by whose means the coating bar 13 can be loaded in a desired manner against the web W. A water groove 25 is provided in cradle 18, which is placed in connection with the coating bar 13. The water circulating in the groove lubricates, cleanses and cools the coating bar 13.

Figure 2:
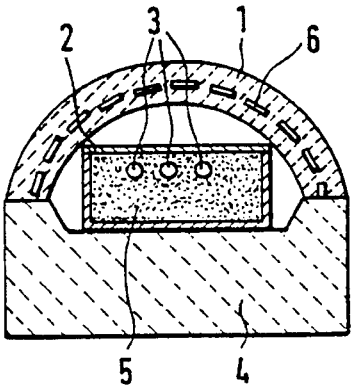
FIGS. 2 and 2*a* show an embodiment of boronizing in accordance with the invention wherein the boronizing is carried out by means of the powder packing process.
Figure 2A:
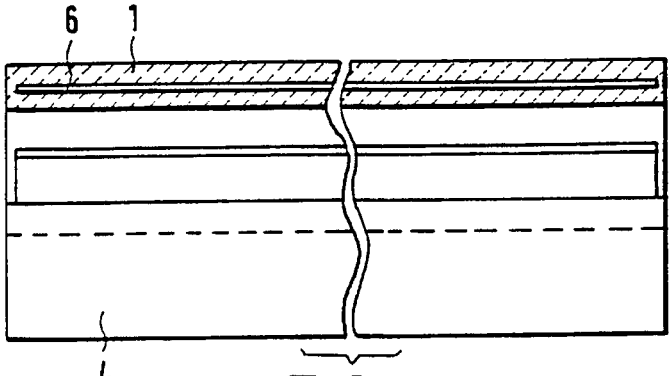

In the powder packing process illustrated in FIGS. 2 and 2*a*, in the horizontal position, the bars 3 are submerged in a vessel 2 made of stainless or fireproof steel. The vessel 2 contains activated boron carbide powder 5. Thereafter, the vessel is placed in an oven, which consists of a base 4 made of refractory bricks and of a cover 1. The cover 1 is made of fireproof ceramic fibre material, into which electric resistor units 6 have been embedded. The temperature of the resistor units 6 is regulated by means of a separate control unit. The temperature is raised by means of the resistor units to a temperature from about 800° C. to about 1050° C., at which temperature the diffusion of the boron into the steel takes place. In this manner, a layer comprising both FeB and $Fe_2B$ is formed on the profiled surface of the coating bar.

The particle size of the boronizing powder is in the range of from about 10 microns to about 1500 microns, depending on the groove size on the bar to be boronized, on the base material, and on the required surface quality.

Figure 6:
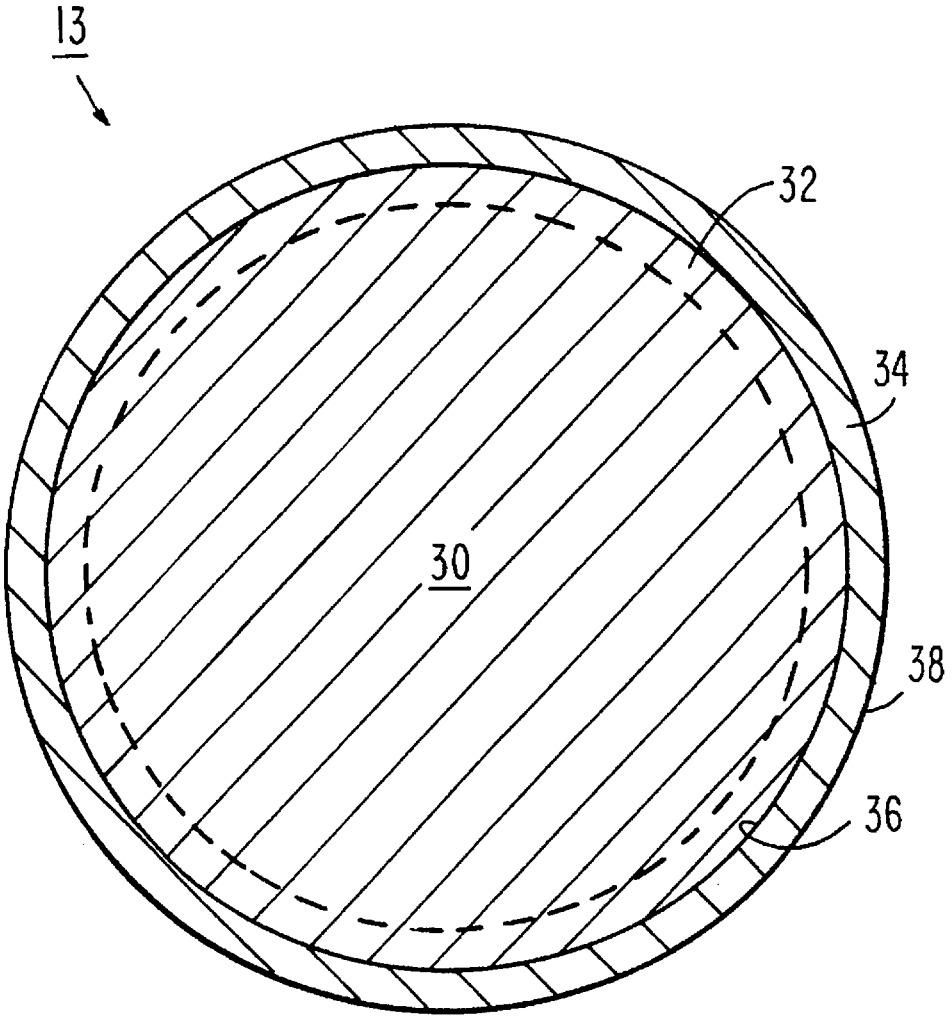
FIG. 6 is a cross-sectional view of a coating bar in accordance with the invention.

FIG. 6 illustrates a cross-sectional view of the coating bar 13 obtained from the diffusion process described with reference to FIGS. 2 and 2*a*. Coating bar 13 is formed from a substantially cylindrical metallic base material or core 30 which includes iron (Fe) so that the iron reacts during the boronizing process to produce iron borides, e.g., FeB and $Fe_2B$, at least in an outer surface region 32 of the core 30. The outer surface region 32 is bound by the outer profiled core surface 36. By continuing the boronization past the stage wherein the iron borides are diffused into the outer surface region 32, a discrete metallic coating 34 containing iron borides is produced in direct contact with the outer profiled core surface 36. The outer bar surface 38 of the metallic coating 34 is exposed is the surface which engages with the coating material. The reaction time of the boronizing process varies from 10 minutes up to 30 hours, depending on the desired thickness of the metallic coating 34. The type and the alloying of the base material in the core 30 also affect the reaction time.

The boronizing powder is available commercially, e.g., under the name EKabor, which is a registered trademark of Messrs. Elektroschmelzwerk Kempten GmbH. The boronizing powder consists of activated boron carbide, $B_4C$, whose boron concentration is from about 40 to about 70%. In this regard, reference is also made to Boronizing by Alfred Graf von Matuschka, Carl Hanser Verlag, Munich, Vienna, 1980, 97 p.

The powder packing process in the vertical position takes place in a way similar to the horizontal processing, but therein the bars, the vessel, and the oven are placed vertically. In this case, it is possible to control the linearity of the bars more efficiently.

In the paste process illustrated in FIGS. 3 and 3*a*, a boronizing paste is spread onto the faces of the bars either by spreading, spraying, or by submerging the bars into a container filled with paste. Thereafter, the bars 3' are placed vertically in a stand 8. The stand is placed into a shield-gas oven under vacuum, said oven consisting of a fireproof or stainless frame 4' and of an insulation 1' of fiber material, into which resistor units 6' have been embedded. The required vacuum is sucked by means of a vacuum pump 7, and the shield-gas atmosphere is provided in the oven by means of nitrogen or argon 9. A shield-gas atmosphere is indispensable in the boronizing paste processing.

It is an advantage of the vertical treatments that the bars can be made to remain straight, because in the vertical position, owing to the bar's own weight, at a high temperature, a creep, i.e. a time-dependent deformation, takes place. The creep (<0.01% per 100 hours) produced as a result of the vertical treatment is so small that it does not affect the geometry of the bar profile. Owing to the vertical position, the direction of the deformation is always the same, such that substantially no distortions arise. On the other hand, distortions arising from creep in the horizontal position are more probable, but in the horizontal processing they have been reduced by applying an axial force to the bar submerged in the powder during the boronizing treatment.

Boronizing paste also commercially available, e.g., under the registered trade mark Ekabor of said Messrs. Elektroschmelzwerk Kempthen GmbH. The boronizing paste is also a product based on boron carbide.

Figures 4, 4A:
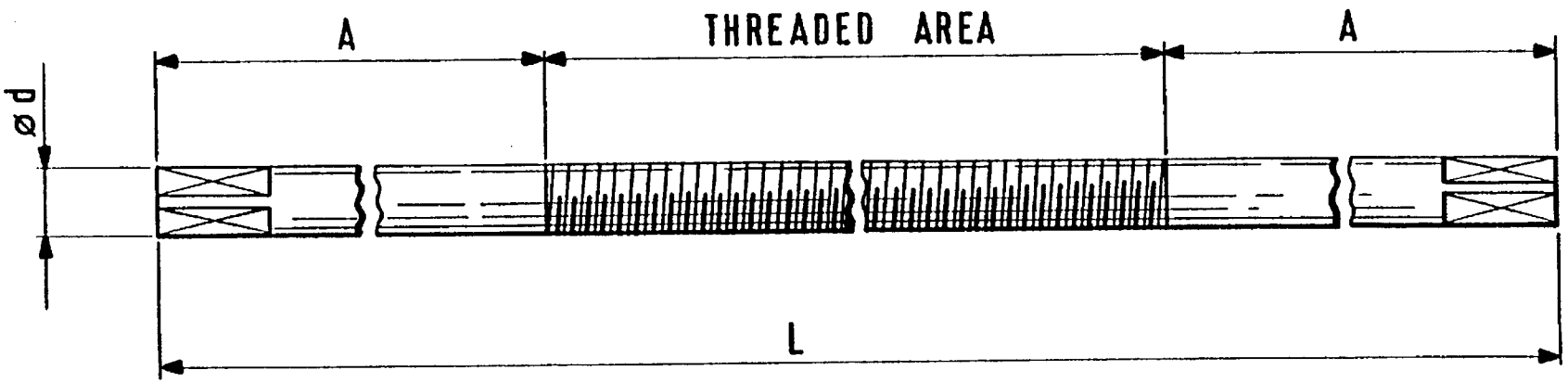
FIGS. 4 and 4*a* are schematic illustrations of a coating bar in accordance with the invention.
Figure 4B:
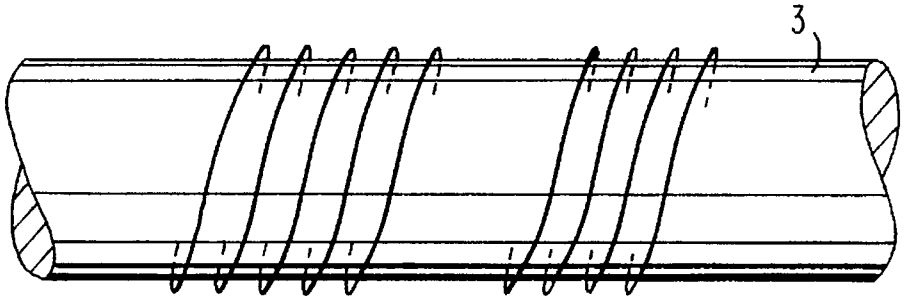
FIG. 4*b* shows the coating bar having a plurality of starts or ridges in a spiral pattern.
Figure 4C:
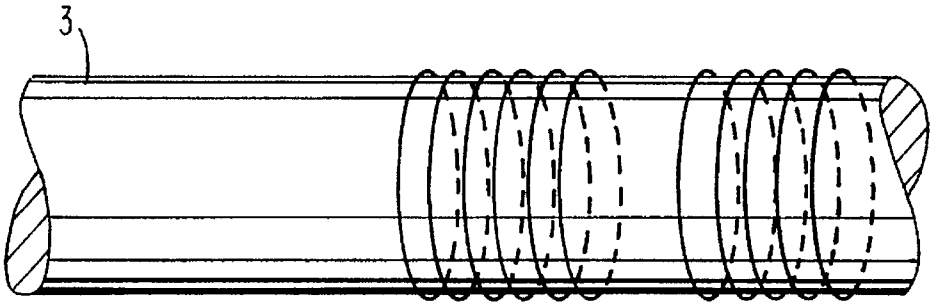
FIG. 4*c* shows the coating bar having a plurality of circular starts or ridges in a repeating pattern.
Figures 5, 5A:
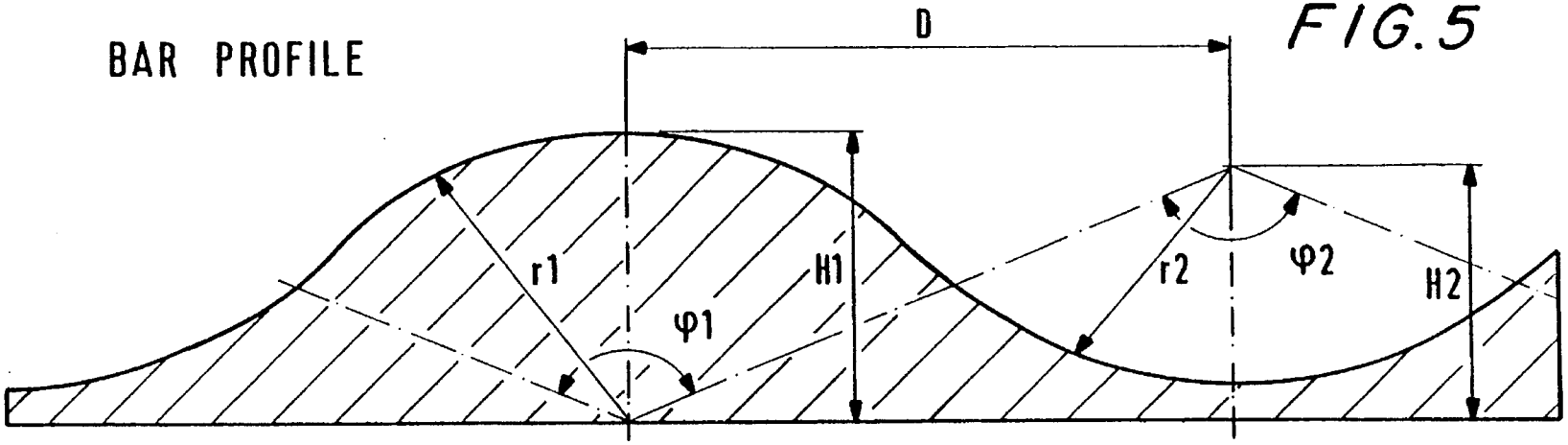
FIGS. 5 and 5*a* are schematic illustrations of different profiles of a coating bar in accordance with the invention.

In FIGS. 4 and 4*a*, a preferred embodiment relating to the threaded area of a coating bar is shown. A detailed illustration of the thread profile is shown in FIGS. 5 and 5*a*. The groove pattern is formed in the coating bar, i.e., the base material, and passes around the bar as spiral-shaped, having from about 1 to about 7 starts or ridges (5 as shown in FIG. 4*b*) or no pitch, i.e., circular (with a repeating pattern of 5 ridges as shown in FIG. 4*c*). The pitch of the thread is understood as meaning the distance in the axial direction of the bar that corresponds to one revolution. The total length L of the coating bar is between about 500 mm and about 12000 mm (0.5 m to 12 m) and the length A of the ungrooved or unthreaded portion of the coating bar on each side of the grooved or threaded portion is from about 0 mm to about 500 mm. The diameter d of the coating bar is from about 8 mm to about 50 mm.

The thread profile passing around the bar can be defined by means of the parameters r1, r2, ϕ1, ϕ2, H1, H2, and D:

ϕ1 area (angle) of effect of the radius of thread ridge

ϕ2 area (angle) of effect of the radius of thread valley r1 radius of ridge r2 radius of valley

H1 height of ridge from the axial base line of the bar, determined by the radius r1

H2 depth of valley from the axial base line of the bar, determined by the radius r1

D distance in the axial direction of the bar equalling half a revolution.

The bar doctor in accordance with the invention is grooved by molding, such as rolling or cutting, before the boronizing treatment based on diffusion, and after the shaping it has been boronized. The surface quality achieved on boronizing is so good that it does not require any major finishing. Owing to the smooth hard surface layer, the wear resistance is substantially higher than that of a conventional bar, and risks of operation, such as tendency of the wire to be broken, have been substantially eliminated.

The bar is rotated by the intermediate of a cardan shaft by a motor in a direction opposite to the sense of rotation of the roll. During operation, the bar contacts the roll coating, which may be abrasive. Moreover, the size to be applied contain abrasive particles, which wears off some of the profile of the bar in the course of time.

An advantage of the present invention over conventional coating bars include high hardness and wear resistance of the surface, because of which the service life is long, because the replacement of a bar causes no standstills. Another advantage of the present invention is that it provides evenness of the hard surface layer as the process is based on diffusion.

Another advantage of the present invention is that it provides good adhesion of the hard surface layer, as the surface layer consists of the base material (with iron borides diffused therein) and there is no separate coating/base material interface. The iron boride-containing outer profiled surface layer is thus is direct connection with a layer of substantially only iron borides. In this regard, the lack of a separate material to form an interface between the coating layer and the base material is a significant advantage as the layer of FeB and $Fe_2B$ is formed directly on the profiled surface. However, it is possible to apply an intermediate layer between the coating layer of FeB and $Fe_2B$ and the base material assuming the adhesion of the coating layer to the coating bar can be assured.

Furthermore, breaks of wire have been eliminated, because there is no wire. However, a potential drawback is the quality (smoothness) of the surface, which is probably inferior to the smoothness of a hard-chromium plated surface.

The invention has been described by way of example with reference to the Figures in the accompanying drawing. The invention is, however, not confined to the exemplifying embodiments shown in the figures alone, but a number of variations are possible within the scope of the inventive idea defined in the following patent claims.

I claim:

1. A coating bar for a bar coater, said coating bar being revolvingly supported substantially over its entire length in a cradle fixed to a frame of the bar coater, said coating bar comprising a substantially cylindrical metallic core having a profiled outer core surface defining a plurality of grooves extending circumferentially around said core, said core having a core surface region bounded by and inward of said profiled outer core surface and comprising FeB and $Fe_2B$, and a discrete metallic coating containing both FeB and $Fe_2B$ situated in direct contact with said profiled outer core surface.

2. The coating bar of claim 1, wherein said grooves are arranged in a certain pattern.

3. The coating bar of claim 2, wherein said grooves in said pattern are spiral-shaped having pitch and said pattern has from 1 to 7 ridges defining said pattern.

4. The coating bar of claim 2, wherein said pattern comprises a repeating pattern of from 1 to 7 circular ridges.

5. The coating bar of claim 1, wherein the hardness of said coating bar including said discrete metallic coating is from about 1100 to about 1700 HV.

6. The coating bar of claim 5 wherein the hardness of said coating bar including said discrete metallic coating is from about 1400 to about 1700 HV.

7. The coating bar of claim 1, wherein the thickness of said discrete metallic coating is from about 5 microns to about 250 microns.

8. The coating bar of claim 7, wherein the thickness of said discrete metallic coating is from about 15 microns to about 25 microns.

9. The coating bar of claim 1, wherein the concentration of boron in said discrete metallic coating is from about 8 to about 20 percent, by weight of the total weight of said discrete metallic coating.

10. The coating bar of claim 1, wherein the concentration of boron in said discrete metallic coating is about 16.23 percent by weight in the FeB compound and about 8.83 percent by weight in the $Fe_2B$ compound.

11. A coating bar for a bar coater, said coating bar being revolvingly supported substantially over its entire length in a cradle fixed to a frame of the bar coater, said coating bar comprising an iron base material having an outer profiled surface comprising FeB and $Fe_2B$, and a single coating layer of FeB and $Fe_2B$ having a first side in direct contact with said outer profiled surface of said iron base material and an exposed second side.

12. The coating bar of claim 11, wherein said coating layer is derived from contact between said profiled surface of said base material and activated boron powder at a temperature at which boronization of said profiled surface occurs.

13. The coating bar of claim 11, wherein said coating bar has a pattern of grooves.

14. The coating bar of claim 13, wherein said pattern of grooves are spiral-shaped having pitch and said pattern of grooves has from 1 to 7 ridges defining said pattern.

15. The coating bar of claim 13, wherein said pattern of grooves comprises a repeating pattern of from 1 to 7 circular ridges.

16. The coating bar of claim 11, wherein the hardness of said coating bar including said coating layer is from about 1100 to about 1700 HV.

17. The coating bar of claim 11, wherein the thickness of said coating layer is from about 5 microns to about 250 microns.

18. The coating bar of claim 11, wherein the concentration of boron in said coating layer is from about 8 to about 20 percent, by weight of the total weight of said coating layer.

19. The coating bar of claim 11, wherein the concentration of boron in said coating layer is about 16.23 percent by weight in the FeB compound and about 8.83 percent by weight in the $Fe_2B$ compound.

20. A coating bar for a bar coater, said coating bar being revolvingly supported substantially over its entire length in a cradle fixed to a frame of the bar coater, said coating bar consisting of an iron base material having an outer profiled surface comprising FeB and $Fe_2B$, and a single coating layer of FeB and $Fe_2B$ directly applied onto said outer profiled surface of said iron base material.

* * * * *